United States Patent [19]

McCabe

[11] Patent Number: 4,472,999

[45] Date of Patent: Sep. 25, 1984

[54] DAMPER OPERATOR FOR USE WITH AIR, SMOKE AND FIRE DAMPERS

[76] Inventor: Francis J. McCabe, 239 Hastings Ct., Doylestown, Pa. 18901

[21] Appl. No.: 229,830

[22] Filed: Jan. 30, 1981

Related U.S. Application Data

[60] Continuation-in-part of Ser. No. 16,514, Mar. 1, 1979, Pat. No. 4,301,569, which is a continuation-in-part of Ser. No. 896,299, Apr. 14, 1978, Pat. No. 4,195,384, which is a continuation-in-part of Ser. No. 799,044, Mar. 18, 1977, Pat. No. 4,099,292, which is a continuation-in-part of Ser. No. 676,483, Apr. 13, 1976, Pat. No. 4,041,570, and Ser. No. 676,413, Apr. 13, 1976, Pat. No. 4,040,304, which is a continuation-in-part of Ser. No. 764,774, Feb. 2, 1977, Pat. No. 4,114,646, which is a continuation of Ser. No. 689,994, May 26, 1976, Pat. No. 4,081,173, said Ser. No. 16,514, is a continuation-in-part of Ser. No. 896,237, Apr. 14, 1978, Pat. No. 4,219,041, and Ser. No. 905,211, May 12, 1978, Pat. No. 4,183,129, which is a division of Ser. No. 729,831, Oct. 4, 1976, Pat. No. 4,113,232.

[51] Int. Cl.[3] ..... F24F 7/00

[52] U.S. Cl. ..... 98/1; 98/86; 137/75; 137/77; 236/101 R; 49/7; 49/8; 16/48.5

[58] Field of Search ..... 49/1, 2, 3, 4, 7, 8; 16/48.5; 236/49, 101 R, DIG. 2, DIG. 5, 93 R; 137/74, 75, 76, 77, 601, 79, 80; 251/66, 67, 68; 98/86, 1, 121 A

[56] References Cited

U.S. PATENT DOCUMENTS

| | | | |
|---|---|---|---|
| 1,515,081 | 11/1924 | Toelle | 137/77 |
| 1,731,214 | 10/1929 | Eshbaugh | 236/93 R X |
| 2,901,064 | 8/1959 | Lasier | 16/48.5 |
| 3,012,446 | 12/1961 | Muehl | 137/77 X |
| 3,718,081 | 2/1973 | Root | 98/121 A X |
| 3,889,314 | 6/1975 | McCabe | 16/48.5 |
| 3,951,051 | 4/1976 | Dry | 137/601 |

*Primary Examiner*—Harold W. Weakley

*Attorney, Agent, or Firm*—Benasutti and Murray

[57] ABSTRACT

A damper operator for use with a damper having a frame and a damper blade pivotally associated with the frame, which damper operator comprises a drive rod; a pair of lever arms which are pivotally associated with each and which extend between the drive rod and a pivoting mechanism associated with the blade of the damper; and a latching mechanism which extends between portions of each of the lever arms, and which permits selective engagement and disengagement between those portions of the lever arms, and accordingly, selective respective rotation of the lever arms, so that the blade of the damper can be urged toward a predetermined orientation.

21 Claims, 8 Drawing Figures

DAMPER OPERATOR FOR USE WITH AIR, SMOKE AND FIRE DAMPERS

RELATED CASES

This is a continuation-in-part of my prior co-pending patent application Ser. No. 16,514, filed Mar. 1, 1979, and entitled "Quadrant Operator", now U.S. Pat. No. 4,301,569, dated Nov. 24, 1981.

U.S. patent application Ser. No. 16,514 is a continuation-in-part of my prior co-pending patent application Ser. No. 896,299, filed Apr. 14, 1978, and entitled "Self-Resetting, Cable Operated Translating Drive Link", now U.S. Pat. No. 4,195,384, dated Apr. 1, 1980; which in turn is a continuation-in-part of my prior co-pending patent application Ser. No. 799,044, filed Mar. 18, 1977, and entitled "Telescoping Heat Responsive Releasing Means", now U.S. Pat. No. 4,099,292, dated July 11, 1978; which in turn is a continuation-in-part of my prior co-pending patent application Ser. No. 676,483, filed Apr. 13, 1976, and entitled "Resettable, Heat Actuatable Fire Link", now U.S. Pat. No. 4,041,570, dated Aug. 16, 1977, as well as a continuation-in-part of my prior co-pending patent application Ser. No. 676,413, filed Apr. 13, 1976, and entitled "Clutch Motor For Use In Resettable Fire Damper", now U.S. Pat. No. 4,040,304, dated Aug. 9, 1977.

U.S. patent application ser. No. 676,413 is also a continuation-in-part of my prior co-pending patent application Ser. No. 764,774, filed Feb. 2, 1977, and entitled "Rotating Blade Fire Damper", now U.S. Pat. No. 4,114,646, dated Sept. 19, 1978; which in turn is a continuation of my prior co-pending patent application Ser. No. 689,994, filed May 26, 1976, and entitled "Rotating Blade Fire Damper", now U.S. Pat. No. 4,081,173, dated Mar. 28, 1978.

U.S. patent application Ser. No. 16,514 is also a continuation-in-part of my prior co-pending patent application Ser. No. 896,237, filed Apr. 14, 1978, and entitled "Electro-Thermal Fire Protection Locking Clip", now U.S. Pat. No. 4,219,041, dated Aug. 26, 1980.

U.S. patent application Ser. No. 16,514 is also a continuation-in-part of my prior co-pending patent application Ser. No. 905,211, filed May 12, 1978, and entitled "Method of Forming A Smoke, Fire and Air Control Damper With Stamped Blade Hinge", now U.S. Pat. No. 4,183,129, dated Jan. 15, 1980; which in turn is a division of my prior co-pending patent application Ser. No. 729,831, filed Oct. 4, 1976, and entitled "Smoke, Fire and Air Control Damper With Stamped Blade", now U.S. Pat. No. 4,113,232, dated Sept. 12, 1978.

BACKGROUND OF THE INVENTION

The present invention relates generally to air, smoke and fire dampers, and more particularly, to a simplified operator for use in conjunction with such dampers.

A variety of dampers have been developed for use in regulating the flow of air through a duct system, as well as for use in controlling the passage of fire or smoke through the duct system. Many duct systems are large enough to acccommodate relatively large, multiple blade-type dampers, which generally include a plurality of hinged blades disposed within a frame. The damper blades are journalled for rotation within the frame of the damper, so that the blades can be opened or closed as desired. Examples of such dampers may be found, for example, in my U.S. Pat. No. 4,113,230, dated Sept. 12, 1978, and entitled "Rotating Blade Fire Damper"; and my U.S. Pat. No. 4,113,232, dated Sept. 12, 1978, and entitled "Smoke, Fire, and Air Control Damper With Stamped Blade."

A variety of damper operators have been developed for use in regulating the positioning of the damper blades between their open and closed position. For example, the damper assemblies previously referred to incorporate an operator which generally comprises a series of brackets attached to each of the blades of the damper, and a connecting rod which is pivotally attached to each of the brackets, so that uniform articulation of the damper blades occurs in response to movement of the connecting rod. Movement of the connecting rod, and accordingly positioning of the damper blades, can then be regulated by any of a variety of control linkages, one example being the linkage shown in my U.S. Pat. No. 4,113,230.

Often, it is important to provide a damper operator which is capable of automatically responding to an external stimulus, such as the smoke or heat of a fire, so that the blades of the damper can be opened or closed, as indicated, both quickly and positively, irrespective of their existing position. One operator which has been developed for this purpose may be found in my co-pending patent application Ser. No. 16,514, filed on Mar. 1, 1979, and entitled "Quadrant Operator". The operator disclosed generally includes a shaft-type actuating means which is selectively interconnected with the connecting rod which is used to regulate movement of the damper blades by a releasing device. The releasing device permits operation of the damper between its open and closed positions during normal conditions, however, upon sensing a selected stimulus, such as heat or smoke, the releasing device is caused to disengage from the connecting rod, so that the damper blades can be urged toward a selected position by an appropriate biasing means.

Such damper operators serve well to properly operate the damper in accordance with the ambient conditions present in the duct system. However, in order to permit the damper blades to be fully rotated between their open and closed position, such damper operators must generally rotate through an arc of approximately 90°, so that their rotation will permit full travel of the connecting rod between its terminating positions. This requires that a sufficient amount of space be provided in order to permit free rotation of the damper operator, as well as free movement of the connecting rod between is terminating positions.

Providing sufficient space to accommodate such damper operators generally does not present a problem when relatively large dampers can be used. However, such damper operators often cannot be used in conjunction with relatively small dampers, for use in duct systems having relatively small cross-sectional dimensions. One method which has been used to overcome this difficulty is to incorporate a damper which is large enough to accommodate a conventionally sized damper operator into a duct system which has been suitably modified to accommodate the larger damper therein. This generally requires that the duct be enlarged at the position where the damper is to be installed, which leads to two major disadvantages. First, it is necessary to specially modify the duct system to accept the larger damper structure. This leads to increased installation costs, as well as increased labor. Second, it is often required that such dampers be installed within portions of the duct system which extend through the fire walls associated with a building. For this reason, it is often not possible to utilize a damper having a cross sectional dimension which exceeds that of the duct, since to do so would require enlargement of the opening in the fire wall which accommodate the duct system, which is undesirable and often not possible.

It is therefore desirable to develop a damper operator which can be used in conjunction with smaller sized dampers, in order to permit such dampers to be installed within the duct system without having to modify or enlarge the duct system.

SUMMARY OF THE INVENTION

In accordance with the present invention, a damper operator is provided which includes a shaft-type actuator which engages the blade of the damper so that movement of the actuator causes damper blade rotation during normal operating conditions, when no fire or smoke is detected, but which releases the damper blade, freeing the damper blade for rotation to a selected position, when fire or smoke is detected. To do so, the actuator is provided with an articulating assembly which comprises a first arm attached to and extending outwardly from the drive rod associated with the actuator; a second arm, pivoted for rotation about the first arm and including means for engaging the damper blade at one end, and a latch at the other end; and a release mechanism extending between the first arm and the latch of the second arm.

During normal operating conditions, the release mechanism is caused to engage the second arm, thus preventing rotation of the second arm about the first arm. As a result, rotational movement of the actuator is transmitted through to the damper blade, which causes its rotation. Controlled movement of the actuator thereby regulates the angular position of the damper blade. In the event that a fire, or other stimulus, is sensed, the release mechanism is caused to disengage the second arm, which permits the second arm to freely rotate about the first arm. This permits the damper blade to be urged toward a pre-selected orientation by appropriate biasing means.

Accordingly, it is a primary object of the present invention to provide a damper operator which can be used in conjunction with relatively small dampers.

It is also an object of the present invention to provide a damper operator which can be used with relatively small dampers and which permits the position of the damper blade to be regulated as desired during normal operating conditions, but which assures that the damper blade can be released, and urged to a selected position, when an appropriate stimulus is encountered.

It is also an object of the present invention to provide a damper operator which is simple in construction and reliable in use.

These and other objects will become apparent from the following detailed description, taken in conjunction with the following illustrations.

BRIEF DESCRIPTION OF THE DRAWINGS

In the several views provided, like reference numerals denote similar structure.

DETAILED DESCRIPTION OF THE PREFERRED EMBODIMENT

Figure 1:
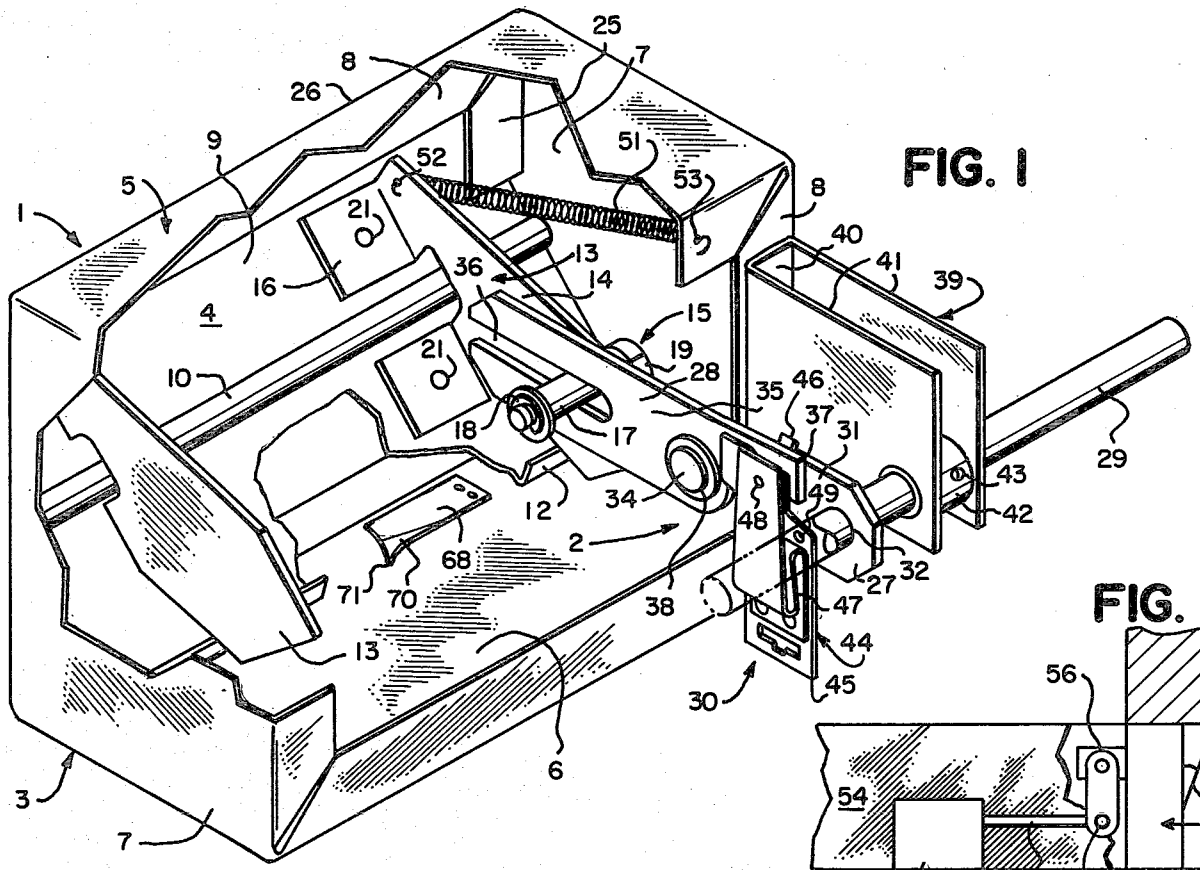
FIG. 1 is a perspective view of the damper and damper operator of the present invention, portions of which have been broken away to show internal construction detail.

Although specific forms of the invention have been selected for illustration in the drawings, and the following description is drawn in specific terms for the purpose of describing these forms of the invention, this description is not intended to limit the scope of the invention which is defined in the appended claims.

FIG. 1 illustrates a damper 1 which has been provided with a preferred embodiment damper operator 2 in accordance with the present invention. The damper 1 is a small, single blade-type damper, which has been selected for illustrative purposes only, it being fully understood that the damper operator of the present invention can also be used with dampers having other sizes, shapes and constructions. The damper 1 selected for illustration in the drawings generally comprises a frame 3, and a damper blade 4 journalled for rotation within the frame 3.

The frame 3 generally includes a top 5, a bottom 6, and two sides 7, which combine to form an enclosure for the damper blade 4. The dimensions of this enclosure are generally selected to substantially correspond to the dimensions of the duct into which the damper 1 is to be installed. Preferably, those portions of the periphery of the frame 3 which are adjacent the damper blade 4 include a flange 8 which extends inwardly toward the center of the damper 1. A similar flange 8 may also be provided along the remaining portions of the periphery of the frame 3, if desired, as illustrated in FIG. 1.

The damper blade 4 generally includes a face 9, and a bracket 13 which is attached to and extends rearwardly from the face 9. The face 9 of the damper blade 4 is substantially planar and includes a centrally disposed hinge 10, and flanged edges 11, 12. The bracket 13 includes a substantially planar surface 14, one end of which is provided with a camming mechanism 15, and the other end of which is provided with a mounting surface 16. A variety of devices may be used as the camming mechanism 15, one example being the device illustrated in the drawings, which includes a ferrule 17 extending outwardly from the surface 14 of the bracket 13, and a lock-washer 18 and pin 19 extending through the ferrule 17, to retain the ferrule 17 to the bracket 13. The mounting surface 16 includes two portions which extend outwardly from the surface 14 of the bracket 13 to form a surface which contacts the planar face 9 of the damper blade 4, so that appropriate attachment means, such as the rivits 20 illustrated, may be used to attach each portion of the mounting surface 16 to the planar face 9 of the damper blade 4.

The damper blade 4 is journalled for rotation within the frame 3 by a plurality of mounting brackets 21 associated with the flange 8 of the frame 3. Each mounting bracket 21 includes a hinge engaging element 24 which extends outwardly from the sides 7 of the frame 3 and into engagement with the hinge 10 of the damper blade 4. In this manner, the damper blade 4 is permitted to freely rotate between a fully open and a fully closed position as illustrated.

Orientation of the damper blade 4 within the damper 1 is controlled by the camming mechanism 15 operatively associated with the bracket 13, in a manner which will be more fully described hereinafter. In the fully open position, it is preferred that the damper blade 4 provide a minimum restriction to the air flow through the damper 1. This is assured by orienting the face 9 of the damper blade 4 so that it is substantially parallel to the air flow through the damper 1. In the closed position, it is preferred that the flanged edges 11, 12 of the damper blade 4 contact the flange 8 of the frame 3, to provide a sealed closure. In order to assure proper closure, while assuring free rotation of the blade 4 within the damper 1, one of the flanged edges 11 is directed inwardly toward the center of the damper 1 so that those portions of the face 9 of the damper blade 4 adjacent the flanged edge 11 are positioned adjacent inner portions 25 of the flange 8, while the other flanged edge 12 is directed outwardly from the damper 1 so that those portions of the face 9 adjacent the flanged edge 12 are positioned adjacent outer portions 26 of the flange 8. In this manner, the upper segment 75 of the face 9 of the damper blade 4 engages the outer portions 24 of the flange 8, while the lower segment 76 of the face 9 engages the inner portions 25 of the flange 8, providing a properly sealed enclosure.

The damper operator 2 generally comprises a drive rod 29; a pair of lever arms 27, 28 which are pivotally associated with each other and which extend between the drive rod 29 and the camming mechanism 15 of the damper blade 4; and a latching mechanism 30 which extends between selected portions of each of the lever arms 27, 28.

Figure 3:
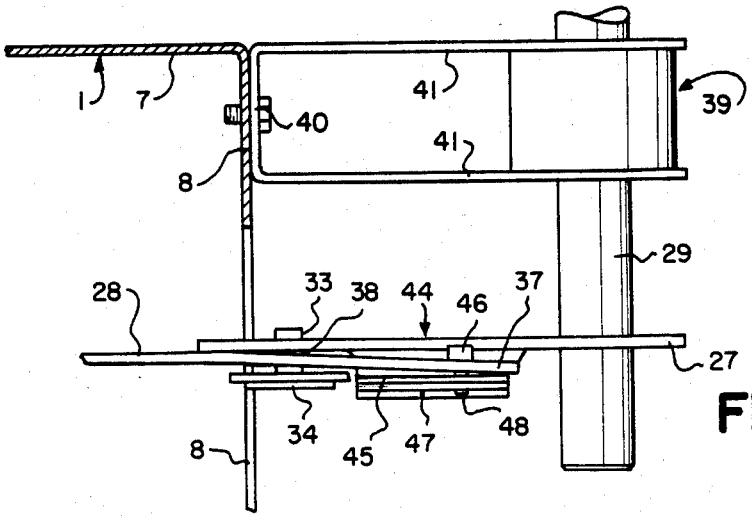
FIG. 3 is a partial, top plan view of the damper of FIG. 2, portions of which have been broken away to show internal construction detail.

As is best illustrated in FIG. 3, the drive rod 29 extends transversely outwardly from a position adjacent the interior of the damper 1, through a support bracket 39, to a position located beyond the side 7 of the damper frame 3. The support bracket 39 includes a base 40, and opposing sides 41 which engage the drive rod 29. The base 40 of the support bracket 39 is attached to the flange 8 of the damper frame 3, thus maintaining the drive rod 29 in its desired orientation. To prevent transverse movement of the drive rod 29 within the mounting bracket 39, a locking bearing 42 is located between the sides 41 of the mounting bracket 39, and around the drive rod 29. A set screw 43 can then be used to maintain proper engagement between the drive rod 29, and the locking bearing 42.

The lever arm 27 includes a substantially planar surface 31 having a substantially cylindrical periphery, each end of which is provided with an aperture. A first aperture 32 has a diameter which substantially corresponds to the diameter of the drive rod 29. Upon assembly, the lever arm 27 is fixedly attached to the drive rod 29, so that rotation of the drive rod 29 will cause rotation of the lever arm 27. The second aperture 33 is sized to accept an appropriate pivoting mechanism, such as the rivit 34 illustrated, to pivotally attach the lever arm 27 to the lever arm 28.

The lever arm 28 also includes a substantially planar surface 35, one end of which is provided with a longitudinally extending U-shaped slot 36 and the other end which is provided with a blade 37. The lever arm 28 is also provided with an aperture 38 for receiving the rivit 34 which pivotally connects the lever arms 27, 28 to each other. The slot 36 of the lever arm 28 has a width which is preferably slightly larger than the diameter of the ferrule 17 of the camming mechanism 15. During assembly, the slot 36 is positioned to engage the ferrule 17, so that rotation of the damper operator 2 causes rotational movement of the bracket 13 of the damper blade 4, thereby moving the damper blade 4 to its desired position. As the bracket 13 is rotated, the ferrule 17 is permitted to slide along the slot 36 of the lever arm 28, thereby assuring free movement of the damper operator 2 and damper blade 4 with respect to each other. Although it is preferable to engage the ferrule 17 within a slotted enclosure such as that shown, it is also possible to allow the ferrule 17 to advance along an unenclosed, outer edge of the lever arm 28, if desired.

Figure 2:
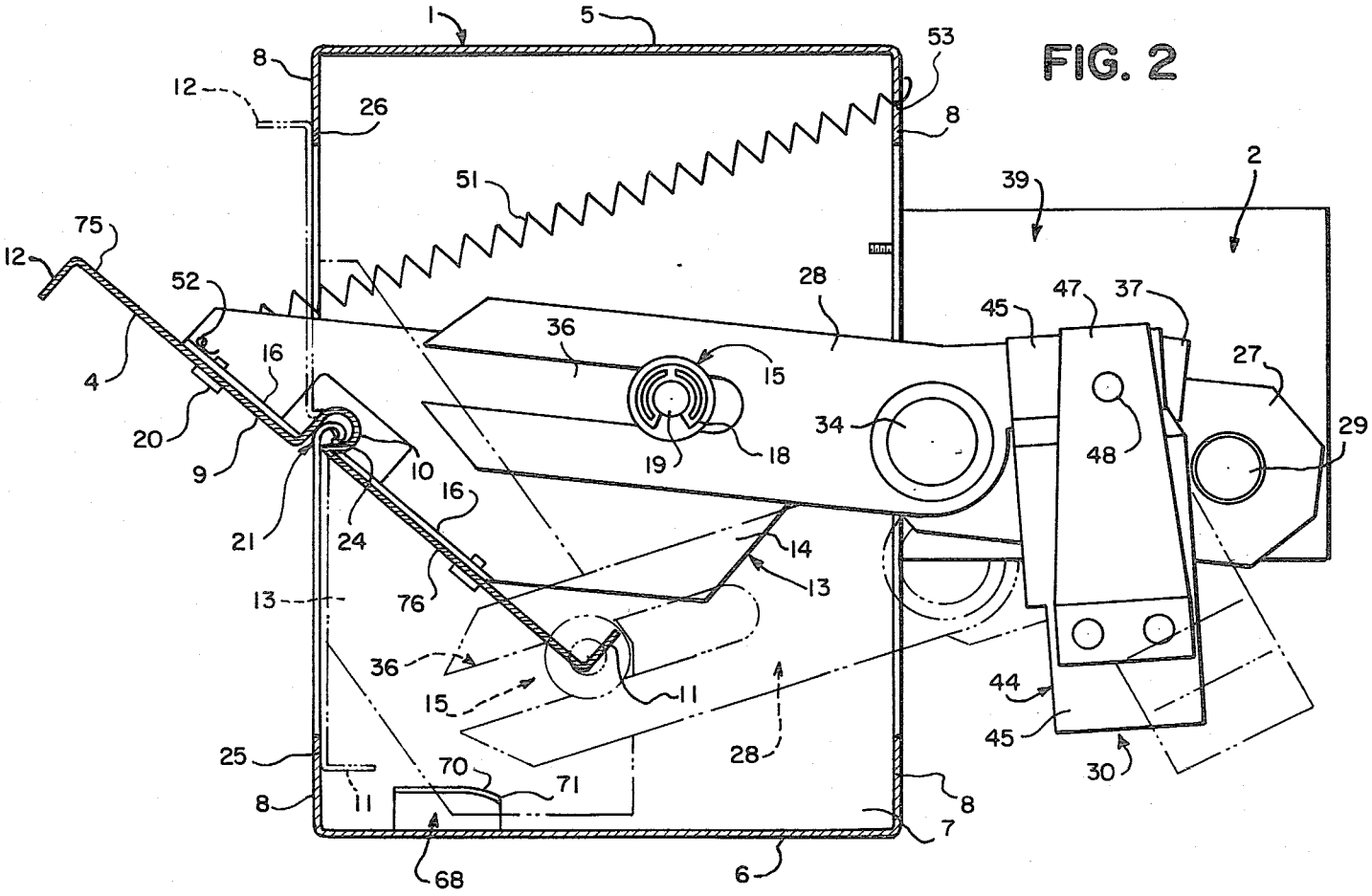
FIG. 2 is a cross-sectional view of the damper, taken along line 2—2 in FIG. 1, which shows the damper blade in its open position.
Figure 5:
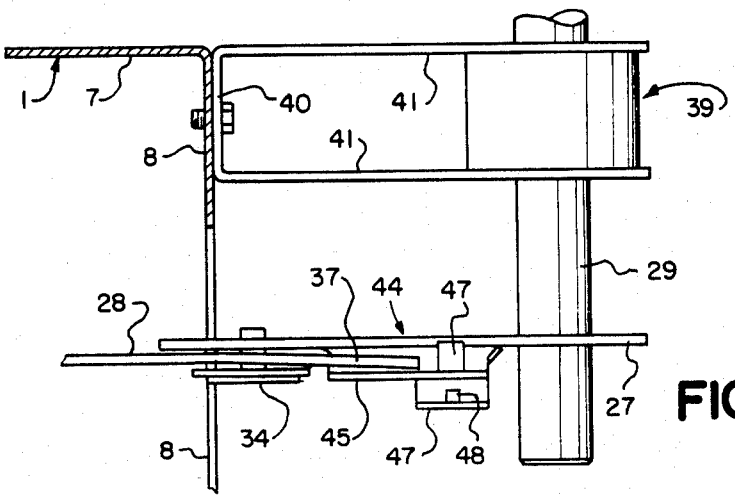
FIG. 5 is a partial, top plan view of the damper of FIG. 4, portions of which have been broken away to show internal construction detail.
Figure 4:
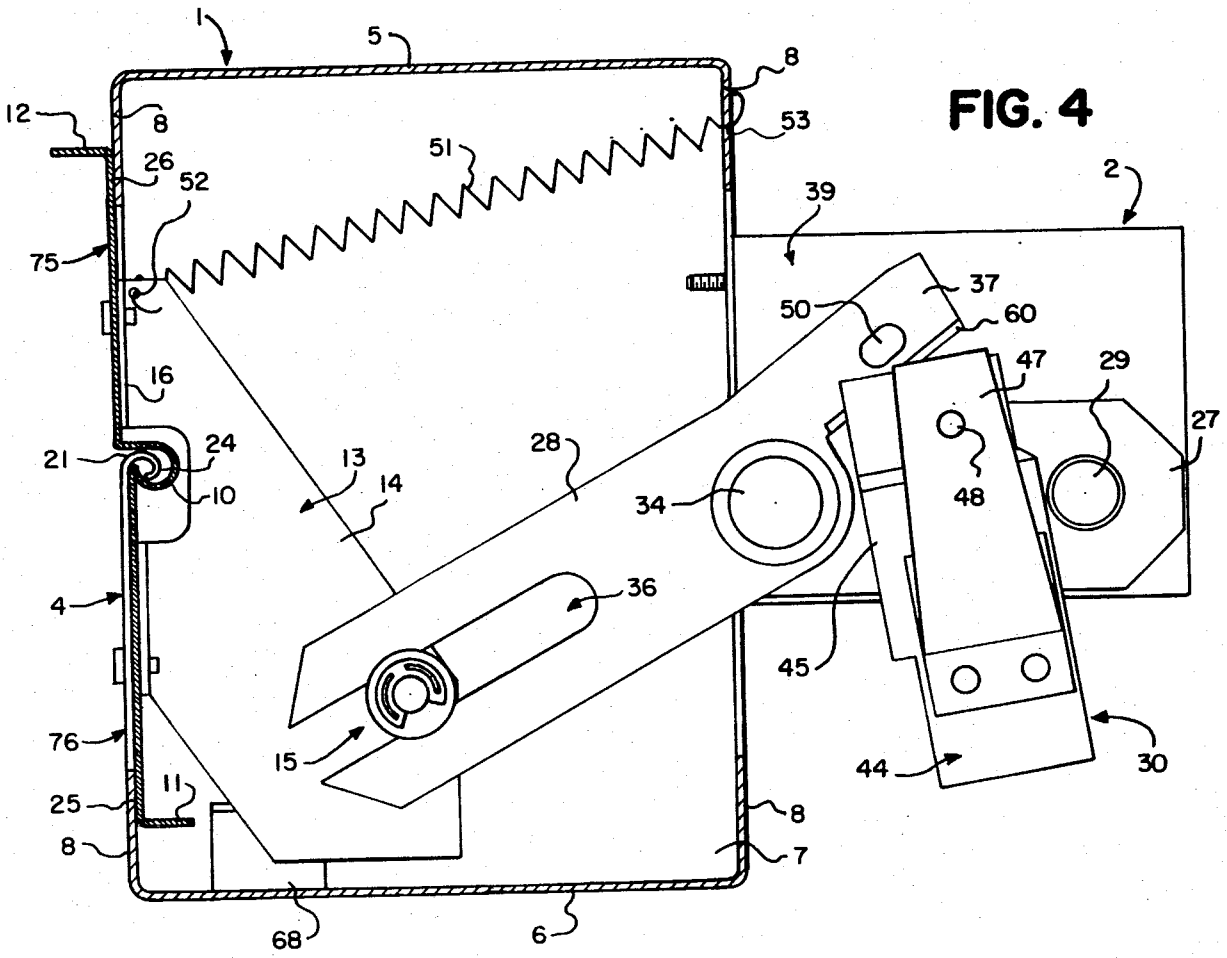
FIG. 4 is a cross-sectional view similar to that of FIG. 2, but which shows the damper blade in its closed position, after release of the articulating assembly.

The latching mechanism 30 regulates respective movement between the lever arms 27, 28. During normal operating conditions, the latching mechanism 30 prevents the lever arm 28 from rotating with respect to the lever arm 27, so that rotation of the drive rod 29 operates the damper blade 4, as illustrated in FIGS. 2 and 3. When a selected stimulus is encountered, such as the heat or smoke of a fire, the latching mechanism 30 releases, permitting the lever arm 28 to rotate with respect to the lever arm 27, which permits the damper blade 4 to be urged toward a selected orientation, as illustrated in FIGS. 4 and 5.

A variety of latching mechanisms 30 may be used to control respective movement between the lever arms 27, 28. One preferred latching mechanism which can be used for this purpose, as illustrated in FIGS. 1-5, is a heat actuated link of the type disclosed in my prior U.S. Pat. No. 3,889,314, dated June 17, 1975, the subject matter of which is incorporated herein by reference. Such a latching mechanism 44 generally includes a base plate 45 having a notch 46 spaced away from and substantially parallel to the base plate 45, and a serpentine, bimetallic element 47, one end of which is attached to the base plate 45 and the other end of which is provided with a latch 48 which extends through the notch 46 to the base plate 45. For use in conjunction with the damper operator 2 illustrated in FIGS. 1-5, the base plate 45 of the latching member 44 is attached directly to the lever arm 27 using, for example, the rivits 49 illustrated. The latching mechanism 44 is positioned on the lever arm 27 so that the latch 48 and the notch 46 are aligned with portions of the blade 37 of the lever arm 28. The blade 37 of the lever arm 28 is provided with an aperture 50 which is sized to receive the latch 48.

Accordingly, during normal operating conditions, the latch 48 extends fully through the notch 46 to the base plate 45 of the latching member 44, so that the blade 37 of the lever arm 28 is positively engaged, preventing respective movement between the lever arms 27, 28. Since the element 47 is formed of a bimetallic material, when the element 47 encounters a source of heat, the element 47 will expand, which draws the latch 48 out of the aperture 50 of the blade 37. This releases the blade 37, thereby permitting the lever arm 28 to pivot with respect to the lever arm 27. This, in turn, frees the camming mechanism 15 associated with the damper blade 4, which permits the damper blade 4 to rotate within the damper frame 3. By attaching a spring 51 between an aperture 52 in the bracket 13 and an aperture 53 the flange 8 of the damper frame 3, the damper blade 4 is caused to move to its closed position. Closure of the damper blade 4 is limited by contact between the flanged edges 11, 12 of the damper blade 4 and the flange 8 of the damper frame 3 as previously described.

Figure 8:
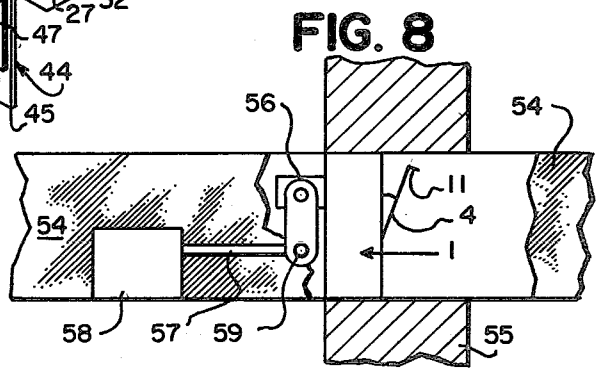
FIG. 8 is a partial, side elevational view illustrating installation of the damper and damper operator of the present invention in a duct.

FIG. 8 illustrates one manner in which the damper illustrated in FIGS. 1–5 can be installed in a duct 54. As illustrated, the duct 54 extends through a firewall 55. It is therefore desirable to position the damper 1 directly within those portions of the duct 54 which extend through the firewall 55, without having to modify the structure of the duct 54. The damper 1 and dampeer operator 2 of the present invention permit this to be done, irrespective of the height of the damper, since the damper operator 2 is capable of operating in small spaces. Installation is accomplished by positioning the damper 1 within the duct 54 so that the frame 3 of the damper 1 is positioned within the firewall 55, and so that the support bracket 39 for the drive rod 29 extends rearwardly from the firewall 55 as shown. In this manner, the damper structure is accommodated within the duct 54, without having to modify the duct, and the drive rod 29 is free to extend outwardly from the duct 54 without interfering with the installation. A drive arm 56 is then attached to the drive rod 29, so that the drive shaft 57 (or cable) of an actuator 58 can engage the drive arm 56 at an appropriate pivot 59.

During normal operating conditions, the latch 48 of the latching mechanism 44 engages the blade 37 of the lever arm 28, so that the lever arms 27, 28 are prevented from rotating with respect to each other. In this manner, rotation of the drive rod 29 causes rotation of the lever arms 27, 28, thereby rotating the damper blade 4 into a position regulated by operation of the actuator 58. This condition will continue until such time as a selected stimulus, such as the heat of a fire, is encountered. The presence of heat in the vicinity of the latching mechanism 44 causes the bimetallic element 47 of the latching mechanism 44 to expand, pulling the latch 48 from the aperture 50 in the blade 37 of the lever arm 28. This frees the lever arm 28 for pivotal movement with respect to the lever arm 27. As a result, the damper blade 4 is drawn toward its closed position by the spring 51, thereby closing the damper and sealing the duct 54 with which it is associated, providing the function of a fire damper.

The damper 1 remains in its closed position until it is reset, which can be accomplished as follows. When the source of heat is removed from the vicinity of the latching mechanism 44, the bimetallic element 47, and the latch 48, are returned to their original position, which causes the latch 48 to advance through the notch 46 to the base plate 45. To reset the damper, the damper blade 4 may be manually rotated toward its open position, or the actuator 58 may be operated in a manner which urges the drive rod 29 and the lever arm 27 toward the position which those elements would normally assume to close the damper blade 4, until the lower edge 60 of the blade 37 is brought into contact with the latch 48 of the latching mechanism 44. By providing the lower edge 60 with a sloping surface, the latch 48 is forced outwardly until the aperture 50 of the blade 37 is brought into alignment with the latch 48, whereupon the latch 48 will be urged into the aperture 50, preventing further respective movement between the lever arms 27, 28. The damper 1 is then ready to resume normal operation, as previously described.

If desired, such a resetting function can also be provided by incorporating a reset arm (arm shown) into the damper operator 2 which is capable of rotating the blade 37 of the lever arm 28 into alignment with the latch 48 as previously described. Such a reset arm may even be used to reset the damper operator 2 from a position external to the duct 54, if desired.

Often, it is desirable to latch the damper blade 4 in its closed position, so that pressures which are created in the duct during the occurance of a fire cannot force the damper blade 4 open. In order to provide this function, a locking clip 68 may be used. The locking clip 68 is preferably formed of a bimetallic material and is preferably attached directly to the bottom 6 of the frame 2 using, for example, the rivits 69 illustrated. During normal operating conditions, the locking clip 68 extends along the bottom 6 of the frame 3, so that the locking clip 68 does not interfere with operation of the damper blade 4. However, when the heat of a fire is present, the locking clip 68 is caused to swing upwardly into the path of the damper blade 4, preventing it from being forced open. To enhance operation of the locking clip 68, it is preferred that the surface of the locking clip 68 be provided with two chamfers 70, 71. The first chamfer 70 is relatively long and gradual, while the second chamfer 71 is relatively short and steep. The chamfers 70, 71 are provided to assure that the damper blade 4 closes over the locking clip 68, even if the locking clip 78 has already partially extended into the path of the damper blade 4 before it has closed. Of course, after the fire has subsided, the locking clip 68 will cool and retract to its original position, adjacent the bottom 6 of the frame 3, freeing the damper blade 4 for continued operation.

It may therefore be seen that the foregoing damper 1 and damper operator 2 serve well to satisfy the several objectives previously set forth. However, it may also be seen that these components can be modified without departing from the present invention. For example, the damper operator of the present invention may be used in conjunction with a variety of dampers, not just the damper 1 illustrated in the drawings. It is even possible for the damper operator 2 of the present invention to be used in conjunction with larger dampers if desired. However, this is considered to be less desirable since the damper operator 2 of the present invention does not provide the same mechanical advantage as the damper operators which are currently used in conjunction with larger dampers.

Figure 7:
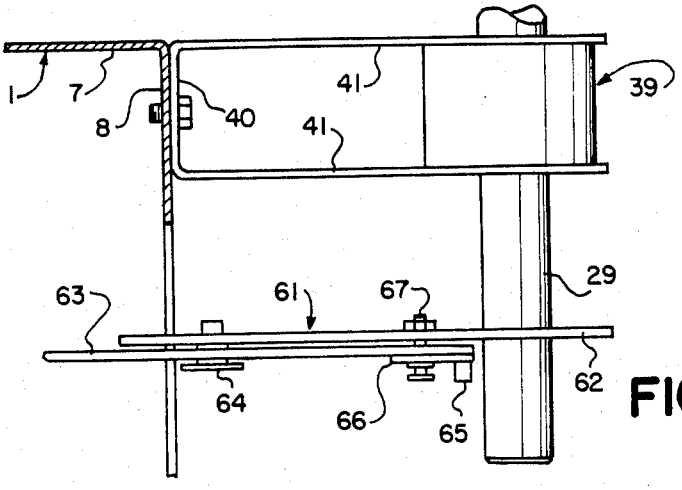
FIG. 7 is a partial, top plan view of the damper of FIG. 6, portions of which have been broken away to show internal construction detail.
Figure 6:
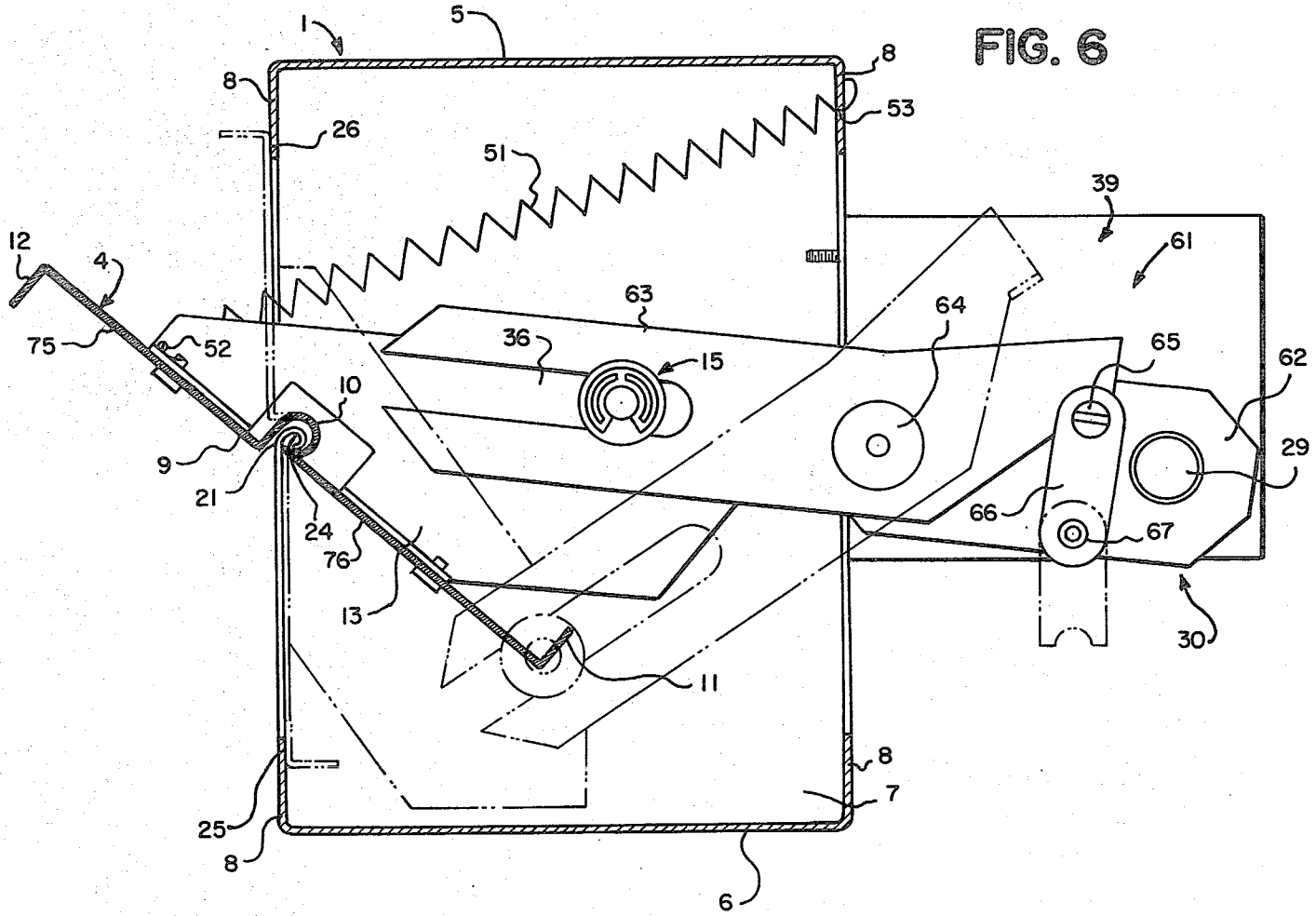
FIG. 6 is a cross-sectional view of a damper which has been provided with an alternative embodiment damper operator.

The structure comprising the damper operator 2 of the present invention can also be modified, so long as a mechanism is provided for assuring selective pivotal rotation between the levers arms 27, 28 in response to a selected stimulus. One example of an alternative embodiment damper operator which may be used for this purpose is illustrated in FIGS. 6 and 7. As before, the damper operator 61 includes a pair of lever arms 62, 63 which are attached for pivotal rotation with respect to each other about the rivit 64, and which extend between the drive rod 29 and the camming mechanism 15 operatively associated with the damper blade 4 as previously described. The lever arms 62, 63 substantially resemble the lever arms 27, 28, except for two differences. First, a hooked end portion 65 is substituted for the blade 37 which was associated with the lever arm 28. Second, a fusible link 66 is substituted for the latching mechanism 44 previously described. The fusible link 66 is attached between the hooked end 65 of the lever arm 63 and a bolt 67 extending from the lever arm 62. As a result, during normal operating conditions, respective movement between the lever arms 62, 63 is prevented. When a source of heat is encountered, the fusible link 66 separates, which permits the lever arm 63 to rotate with respect to the lever arm 62, thereby freeing the damper blade 4 for pivotal movement as previously described. To reset the damper operator 2 for renewed operation, a new fusible link 66 is installed, as previously described.

Other latching mechanisms may also be used. For example, electrically operated devices may be used to provide for selective engagement between the lever arms of the damper operator, if desired. One way in which this may be accomplished is to provide the bimetallic element 47 of the latching mechanism 44 with an electrically heated pad, which permits operation of the latch 48 to be controlled in response to an electrical signal. An example of a mechanism which can be used for this purpose may be found in my U.S. Pat. No. 3,725,972, dated Apr. 10, 1973, and entitled "Fire Link and Method of Actuating Same", the subject matter of which is incorporated herein by reference.

The damper 1 illustrated in FIGS. 1–8 has been provided with a damper operator which provides the function of a fire damper, one which closes upon detecting the presence of heat from a fire. However, the damper operator of the present invention may also be used to provide the function of a smoke damper if desired, one which fully opens upon sensing the presence of smoke. To do so, all that need be done is to provide the damper with a spring which urges the damper blade 4 toward a fully open position, and to suitably modify the release mechanism so that the lever arm 28, 63 is free to rotate to a position which the permits the damper blade 4 to be urged toward its fully open position by the spring associated with the damper.

Lastly, throughout the foregoing description, the lever arms of the damper operator have extended between a rotatable damper blade and a rotatable drive assembly. This permits the damper to be operated as a control damper during normal operating conditions. However, it is not necessary for the damper operator of the present invention to provide the function of a control damper. It is also possible for the damp operator of the present invention to be used to provide only the function of a fire or smoke damper, if desired for a particular application. To do so, the end of the lever arm 27, 62 which is normally provided with the aperture 32 is fixedly attached to the damper frame 3, or a mounting bracket extending from the damper frame 3. Upon sensing the heat or smoke of a fire, operation of the damper operator would proceed as previously described.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. For a damper having a frame, a blade pivotally associated with the frame, and actuator means for varying the orientation of the blade within the frame, an improved damper operator comprising:

a. a first arm fixedly associated with and extending essentially radially from the actuator means;

b. a second arm pivotally associated with and extending between the first arm and the blade of the damper;

c. means for biasing the blade toward a selected orientation; and d. means for selectively interconnecting portions of the first and second arms;

so that the first and second arms are prevented from rotating with respect to each other in a first mode of operation, and so that the first and second arms are permitted to rotate with respect to each other, to permit the blade to rotate toward the selected orientation, in a second mode of operation.

2. The damper of claim 1 wherein the actuator means is pivotally associated with the damper, so that the blade is continuously movable between a fully open and fully closed position.

3. The damper of claim 2 wherein the actuator means comprises a drive rod attached to the first arm and extending transversely, outwardly from the frame of the damper, and a mounting bracket attached to the frame of the damper and adapted for rotational engagement of the drive rod.

4. The damper of claim 1 wherein the second arm includes means for slidingly engaging a pivot operatively associated with the blade.

5. The damper of claim 4 wherein the pivot is a ferrule extending from a bracket attached to and extending outwardly from the blade of the damper.

6. The damper of claim 4 wherein the engaging means is a longitudinally extending, U-shaped slot.

7. The damper of claim 1 wherein the actuator means is fixedly associated with the damper, so that the blade is capable of assuming either a fully open or a fully closed position.

8. The damper of claim 1 wherein the biasing means is a spring extending between portions of the damper blade and portions of the frame of the damper.

9. The damper of claim 1 wherein the interconnecting means comprises:

a. a bimetallic spring element, one end of which is attached to one of the arms of the damper operator, and the other end of which includes a latch portion; and b. a blade portion operatively associated with the other of the arms of the damper operator, and having an aperature adapted to receive the latch portion of the bimetallic spring element.

10. The damper of claim 9 wherein the interconnecting means is electrically operated.

11. The damper of claim 10 wherein the bimetallic spring element further comprises electrically operated heating means operatively associated therewith.

12. The damper of claim 9 wherein the blade portion further includes a sloping surface for assisting interconnection between the blade portion and the latch portion.

13. The damper of claim 1 wherein the interconnecting means comprises a fusible link, one end of which is attached to one of the arms of the damper operator, and the other end of which engages a hooked end portion associated with the other of the arms of the damper operator.

14. For a damper having a frame, and a blade pivotally associated with the frame, an improved damper operator comprising:

a drive means operatively associated with the frame of the damper;

b. a pluralty of interconnected lever arms pivotally associated with each other, opposing ends of which are associated with and extend between the drive means and the blade; and c. means for selectively connecting to each other portions of each of the lever arms, spaced from the pivotal interconnections of the lever arms and the end of the lever arm associated with the drive means;

so that selective engagement between the portions of the lever arms permits selective respective rotation of the lever arms, to permit the blade to be urged to a selected orientation.

15. The damper of claim 1 wherein the first arm is fixedly connected to the actuator means, the second arm is pivotally connected to the first arm, and the pivotal connection between the first arm and the second arm is radially spaced from the fixed connection between the first arm and the actuator means.

16. The damper of claim 15 wherein the interconnecting means is positioned between the pivotal connection between the first arm and the second arm and the fixed connection between the first arm and the actuator means.

17. The damper of claim 1 wherein the second arm has two ends, one of which is pivotally connected to the first arm, and the other of which engages the blade of the damper.

18. The damper of claim 17 wherein the first arm has two ends, one of which is fixedly associated with the actuator means, and the other of which is pivotally associated with the second arm.

19. The damper of claim 6 wherein the second arm has two ends, one of which is pivotally connected to the first arm, and the other of which incorporates the slot.

20. The damper of claim 1 wherein the first arm has two ends, one of which is fixedly associated with the actuator means, and the other of which is pivotally associated with the second arm.

21. For a damper having a frame, a blade pivotally associated with the frame, and actuator means for varying the the orientation of the blade within the frame between a fully open and a fully closed position, and comprising a drive rod pivotally associated with and extending transversely, outwardly from the frame of the damper, an improved damper operator comprising:

a. a first arm fixedly connected to and extending essentially radially from the actuator means;

b. a second arm, one end of which is pivotally connected to portions of the the first arm radially spaced from the fixed connection between the first arm and the actuator means, and the other end of which incorporates a longitudinally extending, U-shaped slot for engaging a pivot associated with the blade of the damper;

c. means for biasing the blade toward a selected orientation; and d. means for selectively interconnecting portions of the first and second arms, positioned between the pivotal connection between the first arm and the second arm and the fixed connection between the first arm and the actuator means;

so that the first and second arms are prevented from rotating with respect to each other in a first mode of operation, and so that the first and second arms are permitted to rotate with respect to each other, to permit the blade to rotate toward the selected orientation, in a second mode of operation.

* * * * *